US008333449B2

(12) United States Patent
Yamamoto

(10) Patent No.: US 8,333,449 B2
(45) Date of Patent: Dec. 18, 2012

(54) DROPLET EJECTION DEVICE THAT ADJUSTS INK EJECTION AMOUNT

(75) Inventor: Shunsuke Yamamoto, Okazaki (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 168 days.

(21) Appl. No.: 12/979,891

(22) Filed: Dec. 28, 2010

(65) Prior Publication Data

US 2011/0234659 A1 Sep. 29, 2011

(30) Foreign Application Priority Data

Mar. 29, 2010 (JP) ..... 2010-074155

(51) Int. Cl.
*B41J 29/38* (2006.01)

(52) U.S. Cl. ..... 347/9; 347/14; 347/19; 347/21

(58) Field of Classification Search ..... 347/5, 9, 347/14, 19, 20, 21, 23
See application file for complete search history.

(56) References Cited

U.S. PATENT DOCUMENTS

| | | | | |
|---|---|---|---|---|
| 6,257,686 | B1 | 7/2001 | Takahashi et al. | |
| 7,399,045 | B2 * | 7/2008 | Nishida et al. | 347/14 |
| 2001/0028370 | A1 | 10/2001 | Takahashi | |
| 2009/0244139 | A1 | 10/2009 | Takahashi | |

FOREIGN PATENT DOCUMENTS

| | | |
|---|---|---|
| JP | H08-216393 | 8/1996 |
| JP | A 2001-301206 | 10/2001 |
| JP | 2006-346931 | 12/2006 |
| JP | 2007-062308 | 3/2007 |
| JP | 2007-098797 | 4/2007 |
| JP | A 2009-241345 | 10/2009 |

OTHER PUBLICATIONS

Office Action dated Mar. 6, 2012 received from the Japanese Patent Office from related Japanese Application No. 2010-074155, together with a partial English-language translation.

* cited by examiner

*Primary Examiner* — Juanita D Jackson
(74) *Attorney, Agent, or Firm* — Scully, Scott, Murphy & Presser, PC

(57) ABSTRACT

A droplet ejection device includes a first determining unit that determines a first amount of liquid on an image pixel basis based on both a second amount and an ejection pattern both obtained from image data, actuator that ejects the first amount of the liquid, a second determining unit that determines a third amount of treating agent on an image pixel basis based on a difference between the first and second amounts, such that a density of the liquid corresponding to a combination of the first amount of the liquid and the third amount of the treating agent comes closer to a density of the liquid corresponding to the second amount of the liquid when there is a difference between the first and second amounts, and a treating-agent application member that applies the third amount of the treating agent to a recording medium.

13 Claims, 10 Drawing Sheets

(a) FIRST ADJUSTING PATTERN (b) SECOND ADJUSTING PATTERN

<BEFORE ADJUSTMENT>
<AFTER ADJUSTMENT>
YELLOW
CYAN
L
L(La)
S(Sa)
M
S
TIME

<BEFORE ADJUSTMENT>
<AFTER ADJUSTMENT>

<BEFORE ADJUSTMENT>
<AFTER ADJUSTMENT>

<BEFORE ADJUSTMENT>
<AFTER ADJUSTMENT>

DROPLET EJECTION DEVICE THAT ADJUSTS INK EJECTION AMOUNT

CROSS REFERENCE TO RELATED APPLICATION

This application claims priority from Japanese Patent Application No. 2010-074155 filed Mar. 29, 2010. The entire content of this priority application is incorporated herein by reference.

TECHNICAL FIELD

The present invention relates to a droplet ejection device for ejecting droplets of ink or the like and also to a control device for controlling the droplet ejection device.

BACKGROUND

There has been known an inkjet printer, which is an example of a droplet ejection device, that ejects ink from an aperture (ejection opening) of a nozzle in fluid communication with a pressure chamber by applying pressure to ink in the pressure chamber through driving of piezoelectric or electrostatic actuator. Also, there is known a tone control, in which an ink amount for each pixel of an image is selected from among a plurality of different amounts (zero (no ejection), small, medium, and large amounts, for example).

However, because of the effect of ejection history, there is a danger that ink is not ejected by a desired amount or in a desired direction. At worst, no ink may be ejected at all. In order to suppress such ejection instability, there has been proposed to determine, on an image pixel basis, an ejection amount of ink in a recording cycle based on ejection amounts of ink in preceding and following recording cycles.

SUMMARY

Although this technology can suppress the ejection instability due to the ejection history, an ink amount for forming a pixel may differ from an amount originally obtained based on image data. In this case, density of printed image may differ from density specified by the image data, thereby degrading image quality.

In view of the foregoing, it is an object of the invention to provide a droplet ejection device capable of suppressing ejection instability due to ejection history and degradation of image quality due to density difference, and also to provide a control device for controlling the droplet ejection device.

In order to attain the above and the other objects, the invention provides a control device for controlling a droplet ejection device. The droplet ejection device includes: a channel unit formed with an ejection opening through which liquid is ejected to form a pixel on a recording medium and a pressure chamber fluidly connected to the ejection opening; an actuator that applies pressure to liquid in the pressure chamber to eject the liquid through the ejection opening; and a treating-agent application member that applies onto the recording medium a treating agent having a function to enhance density of the liquid ejected onto the recording medium. The control device includes a processor configured to execute instructions that cause the processor to provide functional units including a first determining unit that determines a first amount of the liquid to be ejected through the ejection opening on an image pixel basis based on both a corresponding second amount of the liquid specified by image data corresponding to an image to be formed on the recording medium and ejection pattern obtained from the image data, an actuator control unit that controls the actuator to eject the first amount of the liquid through the ejection opening, a second determining unit that determines a third amount of the treating agent to be applied by the treating-agent application member on an image pixel basis based on a difference between the first amount and the second amount, and a control unit that controls the treating-agent application member to apply the third amount of the treating agent to the recording medium. The second determining unit determines the third amount such that a first density of the liquid corresponding to a combination of the first amount of the liquid and the third amount of the treating agent comes closer to a second density of the liquid corresponding to the second amount of the liquid when there is a difference between the first amount and the second amount;

According to another aspect, the present invention provides a non-transitory computer readable storage medium storing a set of program instructions installed on and executed by a computer for controlling a droplet ejection device. The droplet ejection device includes: a channel unit formed with an ejection opening through which liquid is ejected to form a pixel on a recording medium and a pressure chamber fluidly connected to the ejection opening; an actuator that applies pressure to liquid in the pressure chamber to eject the liquid through the ejection opening; and a treating-agent application member that applies onto the recording medium a treating agent having a function to enhance density of the liquid ejected onto the recording medium. The program instructions includes determining a first amount of the liquid to be ejected through the ejection opening on an image pixel basis based on both a corresponding second amount of the liquid specified by image data corresponding to an image to be formed on the recording medium and ejection pattern obtained from the image data; controlling the actuator to eject the first amount of the liquid through the ejection opening; determining a third amount of the treating agent to be applied by the treating-agent application member on an image pixel basis based on a difference between the first amount and the second amount, such that a first density of the liquid corresponding to a combination of the first amount of the liquid and the third amount of the treating agent comes closer to a second density of the liquid corresponding to the second amount of the liquid when there is a difference between the first amount and the second amount; and controlling the treating-agent application member to apply the third amount of the treating agent to the recording medium.

According to still another aspect, the present invention provides a droplet ejection device including: a channel unit formed with an ejection opening through which liquid is ejected to form a pixel on a recording medium and a pressure chamber fluidly connected to the ejection opening; an actuator that applies pressure to liquid in the pressure chamber to eject the liquid through the ejection opening; a treating-agent application member that applies onto the recording medium a treating agent having a function to enhance density of the liquid ejected onto the recording medium; a first determining unit that determines a first amount of the liquid to be ejected through the ejection opening on an image pixel basis based on both a corresponding second amount of the liquid specified by image data corresponding to an image to be formed on the recording medium and ejection pattern obtained from the image data; an actuator control unit that controls the actuator to eject the first amount of the liquid through the ejection opening; a second determining unit that determines a third amount of the treating agent to be applied by the treating-agent application member on an image pixel basis based on a difference between the first amount and the second amount; and a control unit that controls the treating-agent application member to apply the third amount of the treating agent to the recording medium. The second determining unit determines the third amount such that a first density of the liquid corresponding to a combination of the first amount of the liquid and the third amount of the treating agent comes closer to a second density of the liquid corresponding to the second amount of the liquid when there is a difference between the first amount and the second amount

BRIEF DESCRIPTION OF THE DRAWINGS

The particular features and advantages of the invention as well as other objects will become apparent from the following description taken in connection with the accompanying drawings, in which:

FIG. 8(*b*) is an explanatory diagram showing a second adjusting pattern according to the first embodiment of the invention;

FIG. 9(*b*) is an explanatory diagram showing a second example of ink amount determining method;

FIG. 10(*b*) is an explanatory diagram showing a fourth example of ink amount determining method;

FIG. 10(*c*) is an explanatory diagram showing a fifth example of ink amount determining method; and FIG. 10(*d*) is an explanatory diagram showing a sixth example of ink amount determining method.

DETAILED DESCRIPTION

Figure 1:
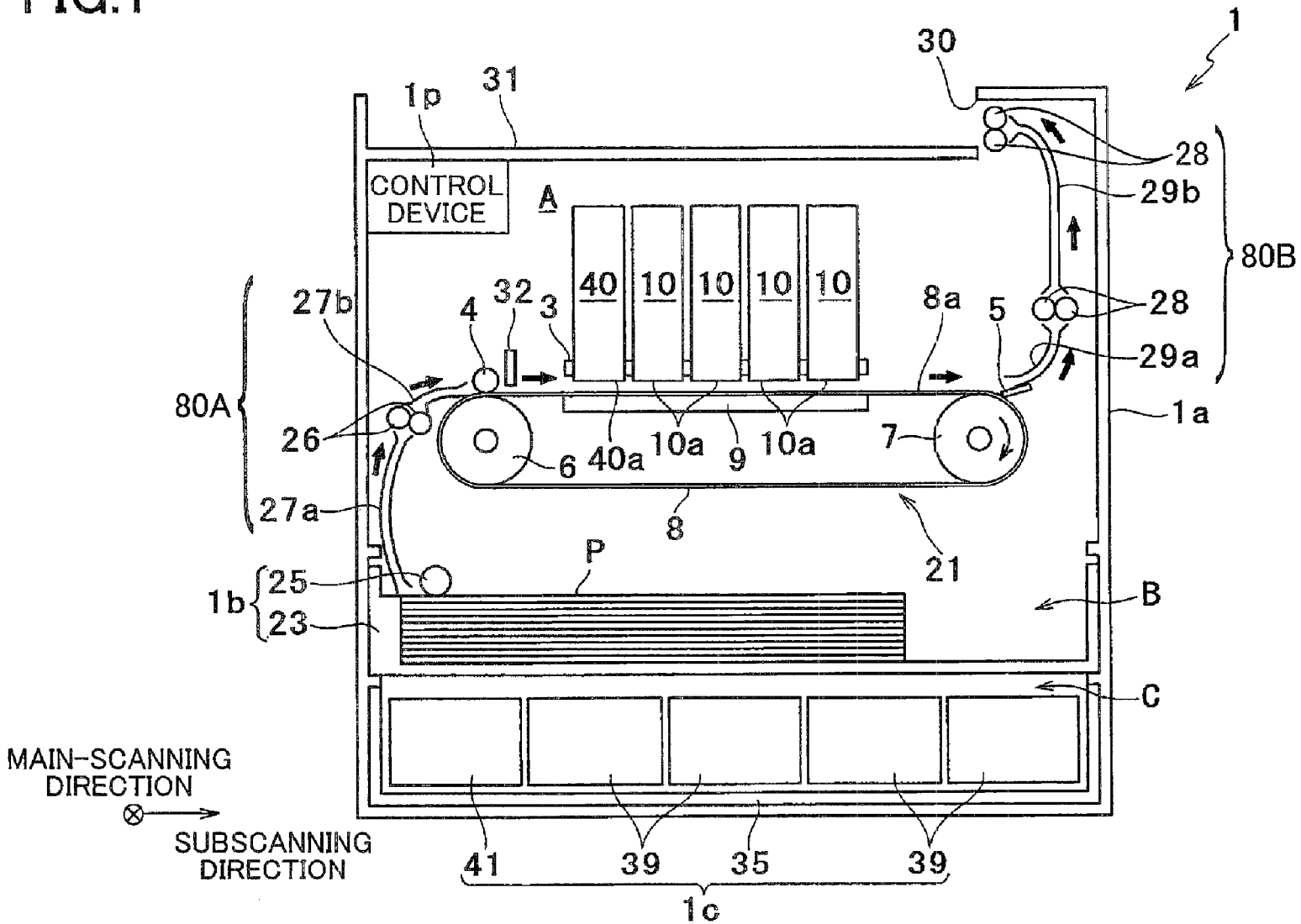
FIG. 1 is an explanatory cross-sectional side view of an inkjet printer according to a first embodiment of the invention.

A droplet ejection device according to embodiments of the invention will be described while referring to the accompanying drawings wherein like parts and components are designated by the same reference numerals to avoid duplicating description. The embodiments pertain to an inkjet printer 1 shown in FIG. 1.

The terms "up," "down," "upward," "beneath," and the like will be used throughout the description assuming that the inkjet printer 1 is disposed in an orientation in which it is intended to be used. In use, the inkjet printer 1 is disposed as shown in FIG. 1.

As shown in FIG. 1, the inkjet printer 1 includes a box-shaped casing 1*a*, which is provided with a discharge section 31 on top thereof and defining inner spaces A, B, and C in the order of up to down.

The casing 1*a* accommodates in the inner space A a pre-coat head 40, four inkjet heads 10, a conveying unit 21 for conveying a paper sheet P, and an upstream guide 80A and a downstream guide 80B for guiding the paper sheet P. The casing 1*a* also accommodates at an upper section in the inner space A a control device 1*p* for performing overall control of the inkjet printer 1 by controlling operation of each component of the inkjet printer 1. The control device 1*p* controls printing operation based on image data received from an external device. The printing operation includes an operation for conveying the paper sheet P by various components of the inkjet printer 1, an operation for ejecting droplets of ink and droplets of pre-treating agent in synchronization of conveyance of the paper sheet P, and the like.

The conveying unit 21 includes a follow roller 6, a drive roller 7, an endless conveying belt 8 wound around and extended between the rollers 6 and 7, a nip roller 4 and a separating plate 5 disposed outside the conveying belt 8, and a platen 9 disposed inside the conveying belt 8. The drive roller 7 is driven to rotate by a conveying motor 121 (FIG. 5) in a clockwise direction in FIG. 1. Rotation of the belt roller 7 circulates the conveying belt 8 in the clockwise direction in FIG. 1, which in turn rotates the follow roller 6 in the clockwise direction in FIG. 1. The nip roller 4 is disposed in confrontation with the follow roller 6 and presses the paper sheet P onto a support surface 8*a*, which is an outer surface of the conveying belt 8. The paper sheet P pressed onto the support surface 8*a* by the nip roller 4 is held on the support surface 8*a* and conveyed toward the drive roller 7 by the circulation of the conveying belt 8. The separating plate 5 is disposed in confrontation with the drive roller 7 and separates the paper sheet P from the support surface 8*a* of the conveying belt 8 such that the paper sheet P is further conveyed toward the downstream side in a sheet conveying path, which is defined in the inner spaces A and B. The platen 9 is disposed in confrontation with all of the pre-coat head 40 and the four inkjet heads 10, and supports an upper section of the conveying belt 8 from below.

Figure 3:
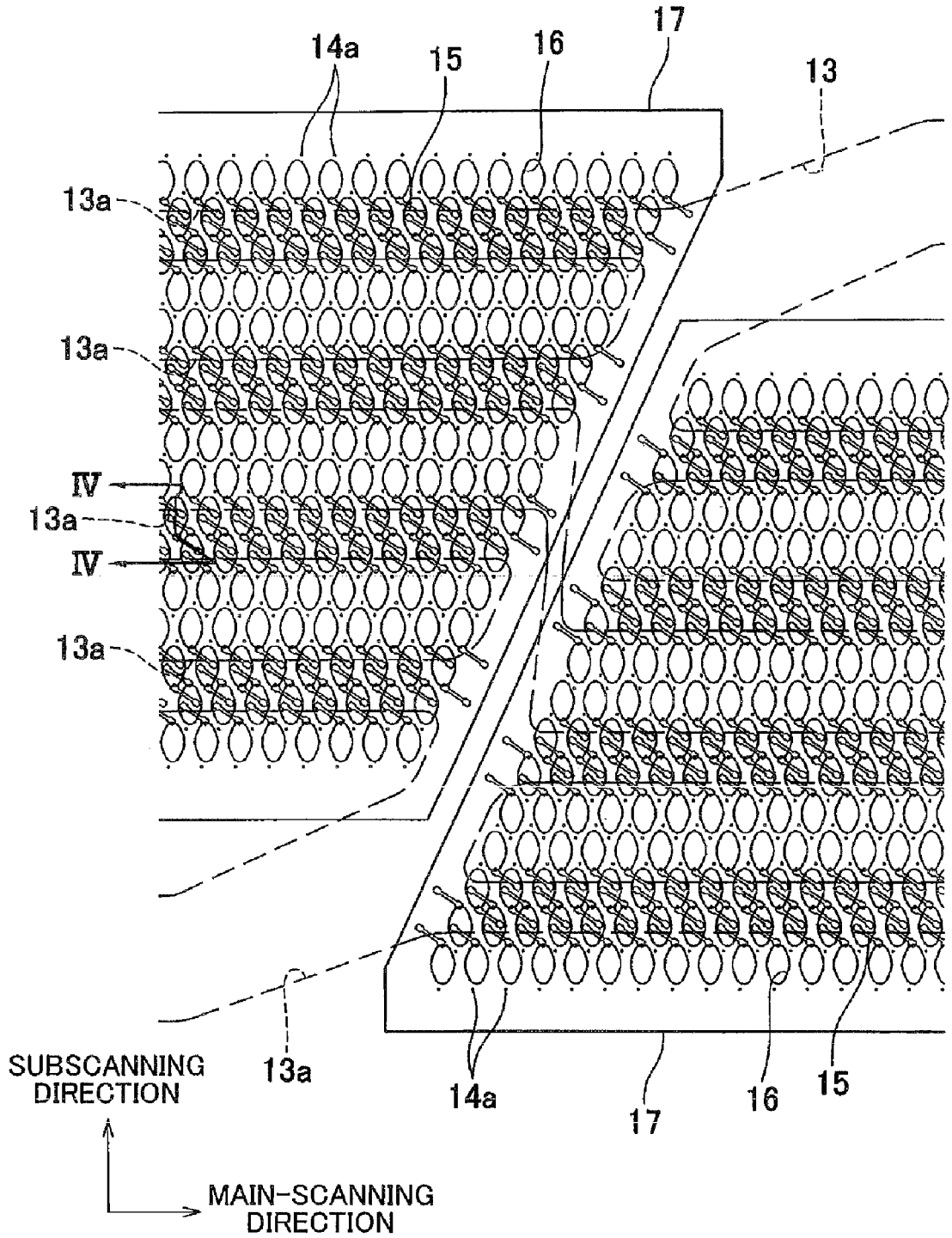
FIG. 3 is an enlarged view of a part of FIG. 2 encircled by a single-dot chain line III.
Figure 4:
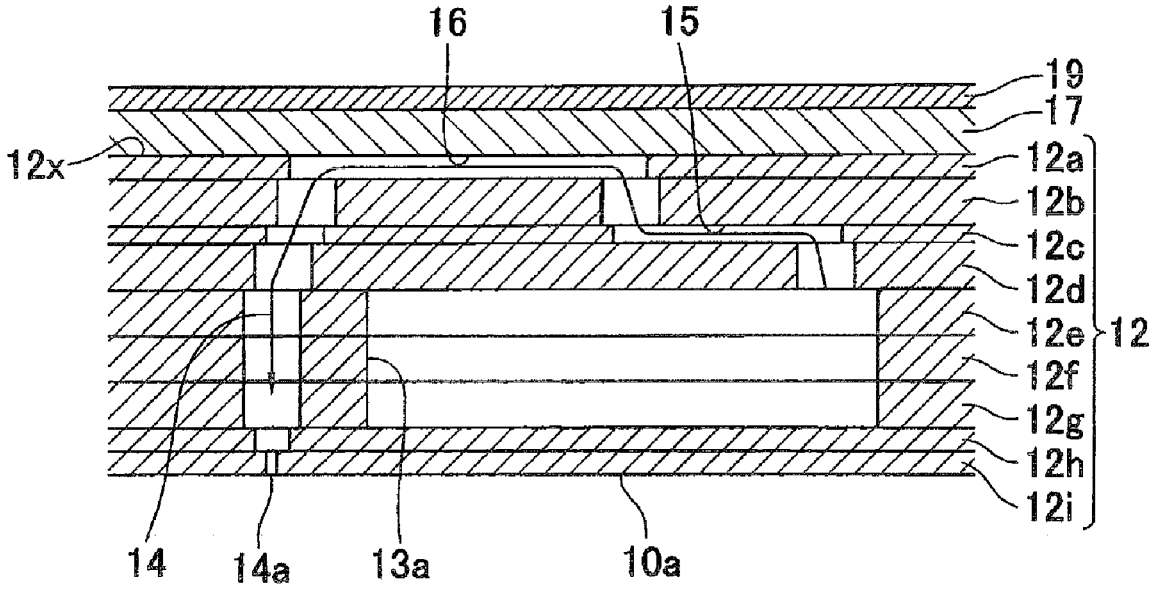
FIG. 4 is a cross-sectional view taken along a line IV-IV of FIG. 3.

Each of the heads 10 and 40 is a box-shaped line head having a long dimension in a main-scanning direction, and has on its bottom an ejection surface 10*a*, 40*a* formed with a plurality of nozzles. (FIGS. 3 and 4 show nozzles 14*a* of the inkjet heads 10.) During printing, ink droplets of colors black, magenta, cyan, and yellow are respectively ejected from the ejection surfaces 10*a* of the inkjet heads 10. Also, as will be described later, droplets of the pre-treating agent are ejected from the ejection surface 40*a* of the pre-coat head 40 onto the paper sheet P as needed before ink droplets impinge the paper sheet P. The heads 10 and 40 are aligned at regular intervals in a subscanning direction, and are supported to the casing 1*a* via a head holder 3. That is, the head holder 3 supports the heads 10 and 40 such that the ejection surfaces 10*a* and 40*a* confront the support surface 8*a* of the conveying belt 8 with an appropriate interval for printing. Configurations of the heads 10 and 40 will be described in greater detail later.

The upstream guide 80A is disposed on the upstream side of the conveying unit 21 in a sheet conveying direction for leading the paper sheet P from a sheet supply unit 1*b* (described later) to the conveying unit 21, and includes guides 27*a* and 27*b* and a pair of feed rollers 26. The downstream guide 80B is disposed on the downstream side of the conveying unit 21 in the sheet conveying direction for leading the paper sheet P from the conveying unit 21 to the discharge section 31, and includes guides 29*a* and 29*b* and two pairs of feed rollers 28.

The sheet supply unit 1*b* is detachably accommodated in the inner space B of the casing 1*a*. The sheet supply unit 1*b* includes a sheet supply tray 23 and a sheet supply roller 25. The sheet supply tray 23 is in an open-top box shape and capable of accommodating paper sheets P in various sizes. The sheet supply roller 25 feeds an upper one of the paper sheets P accommodated in the sheet supply tray 23 to the upstream guide 80A.

As described above, the sheet conveying path extending from the sheet supply unit 1*b* to the discharge section 31 via the conveying unit 21 is defined in the inner spaces A and B. Based on a recording command received from an external device, the sheet supply unit 1*b* drives a sheet-supply motor 125 (FIG. 5) for the sheet supply roller 25, a feed motor 127 (FIG. 5) for the guides 80A and 80B, the conveying motor 121 (FIG. 5), and the like.

The paper sheet P fed from the sheet supply tray 23 is supplied to the conveying unit 21 by the feed rollers 26. When the paper sheet P is conveyed directly below each head 10, 40, ink droplets of each color are ejected from the heads 10 in sequence (and droplets of pre-treating agent are also ejected from the pre-coat head 40 if needed). As a result, a color image is formed on the paper sheet P. Ejections of the droplets of the ink and the pre-treating agent are performed under the control of the control device 1*p* based on detection signal output from a sheet sensor 32. The paper sheet P with the image formed thereon is separated from the conveying belt 8 by the separating plate 5, conveyed upward by the pairs of feed rollers 28, and discharged onto the discharge section 31 through an opening 30.

Note that the subscanning direction is parallel to a direction in which the conveying unit 21 conveys the paper sheet P, and the main-scanning direction is parallel to a horizontal plane and perpendicular to the subscanning direction.

The casing 1*a* also accommodates a cartridge unit 1*c* in the inner space C. The cartridge unit 1*c* is detachable from the casing 1*a*, and includes a tray 35, a pre-treating agent cartridge 41, and four ink cartridges 39. These five cartridges 41 and 39 are all accommodated in the tray 35 and juxtaposed next to one another. Each of the cartridges 41 and 39 stores and supplies the pre-treating agent or ink of each color to the corresponding head 40 or 10 through a tube (not shown).

Next, configurations of the heads 10 and 40 will be described in greater detail. Because the heads 10 and 40 have the same configuration, only the configuration of one of the inkjet heads 10 will be described with reference to FIGS. 2 to 4. Note that in FIG. 3 pressure chambers 16 and apertures 15 that are located behind actuator units 17 and that should be depicted in dotted chain lines are depicted in solid lines instead.

Figure 2:
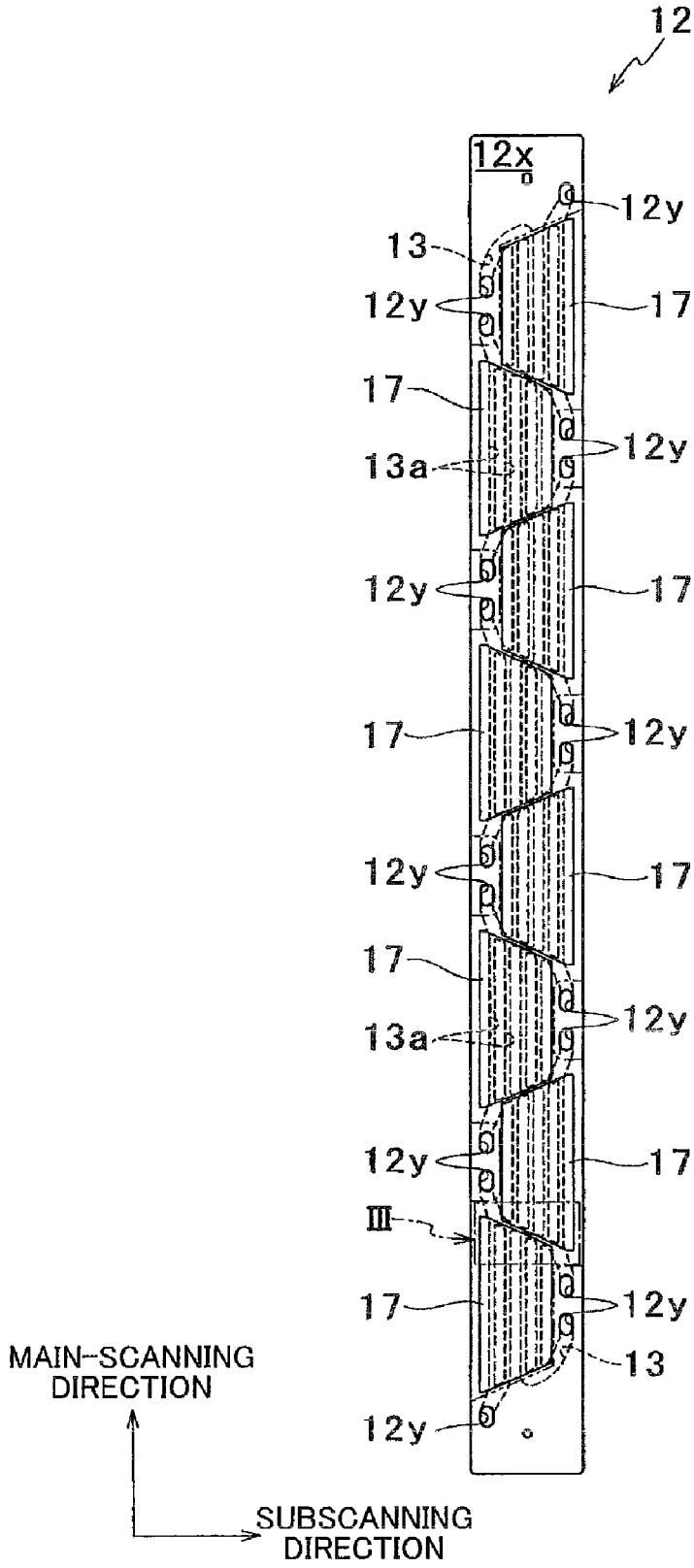
FIG. 2 is a top view of a channel unit and actuator units of an inkjet head of the inkjet printer shown in FIG. 1.

As shown in FIGS. 2 and 4, the inkjet head 10 includes a channel unit 12 having the ejection surface 10*a*, eight actuator units 17 fixed on an upper surface 12*x* of the channel unit 12, a flexible printed circuit (FPC) 19 conned to each actuator unit 17, and a reservoir unit (not shown). The channel unit 12 is formed with a plurality of channels, each fluidly connecting one of openings 12*y* (FIG. 2) formed in the upper surface 12*x* to corresponding nozzles 14*a* formed in the ejection surface 10*a*. Each actuator unit 17 includes piezoelectric actuators in one-to-one correspondence with the nozzles 14*a*.

The reservoir unit (not shown) is formed with a channel including a reservoir for temporarily storing ink supplied from the ink cartridge 39. The reservoir unit has a bottom surface formed with protrusions and recesses. Each protrusion is fixed to the upper surface 12*x* of the channel unit 12 in an area where no actuator unit 17 is disposed (area indicated by two-dotted chain line in FIG. 2, in which the openings 12*y* are formed). Each protrusion is formed in its end with an opening that is in fluid communication with the reservoir and opposing the opening 12*y* of the channel unit 12. Thus, the reservoir is fluidly connected to each individual channel 14 (FIG. 4, described later) via the opening at the end of the protrusion. The recesses, on the other hand, oppose the upper surface 12*x* of the channel unit 12, the surface of the actuator unit 17, and the surface of the FPC 19, with tiny gaps therebetween.

The channel unit 12 is a laminated body formed by laminating and bonding one on the other nine metal plates 12*a*, 12*b*, 12*c*, 12*d*, 12*e*, 12*f*, 12*g*, 12*h*, and 12*i*, having substantially the same size (see FIG. 4). As shown in FIGS. 2, 3, and 4, the channel unit 12 is formed with a plurality of manifold channels 13 having the openings 12*y* at one end, a plurality of sub-manifold channels 13*a* arising from each manifold channel 13, and a plurality of individual channels 14 fluidly connecting the sub-manifold channels 13*a* to the corresponding nozzles 14*a*. The individual channels 14 are formed in one-to-one correspondence with the nozzles 14*a*, and each includes a pressure chamber 16 and an aperture 15. The aperture 15 functions as a throttle for controlling flow channel resistance. A matrix of rhombic-like openings for exposing the pressure chambers 16 are formed in each area of the upper surface 12*x* where the actuator unit 17 is attached. Also, a matrix of the nozzles 14*a* is formed in the same arrangement as the pressure chambers 16 in each area of the ejection surface 10*a* in opposition to the actuator unit 17.

As shown in FIG. 2, the actuator units 17 are in trapezoidal flat shape and arranged in a two-row staggered pattern on the upper surface 12*x* of the channel unit 12. As shown in FIG. 3, each actuator unit 17 covers over the openings of the number of pressure chambers 16 located in the attachment area for the actuator unit 17. Although not shown in the drawings, the actuator unit 17 includes a plurality of piezoelectric layers stretching over the pressure chambers 16 and electrodes sandwiching the piezoelectric layers in a thickness direction. The electrodes include individual electrodes provided in one-to-one correspondence with the pressure chambers 16 and a common electrode provided commonly for the pressure chambers 16. The individual electrodes are disposed on an upper surface of upper one of the piezoelectric layers.

The FPC 19 includes a wiring for each electrode of the actuator unit 17, and a driver IC (not shown) is disposed midway on the wiring. The FPC 19 has one end fixed to the actuator units 17 and the other end fixed to a control board (not shown) of the inkjet head 10 disposed above the channel unit 12. Under the control of the control device 1*p*, the FPC 19 transmits various driving signals output from the control board to the driver IC, and transmits signals generated by the driver IC to the actuator units 17.

Note that the pre-treating agent is supplied to the reservoir of the reservoir unit of the pre-coat head 40 from the pre-treating agent cartridge 41.

The pre-treating agent enhances density of ink ejected onto the paper sheet P. The pre-treating agent may also prevent ink blur and ink seep through, improve color development, reduce dry time, and prevent the paper cockle and curl that may occur after ink ejection. Note that "ink seep through" means that ink ejected on a surface of a paper sheet P seeps through the paper sheet P to the other side thereof. The pre-treating agent may be produced from, for example, liquid containing multivalent metal salt such as magnesium salt and cationic polymer. When pigment ink is used, an agent having a function to cause pigment aggregation is used as the pre-treating agent. When dye ink is used, on the other hand, an agent having a function to cause dye precipitation is used as the pre-treating agent. When ink is ejected in a region on a paper sheet P where such treating agent has been applied, then the multivalent metal or the like acts on the pigment or the dye (colorant of the ink) to form insoluble or hardly-soluble metal complex by aggregation or precipitation, thereby enhancing ink density.

Next, electrical configuration of the inkjet printer 1 will be described with reference to FIG. 5.

Figure 5:
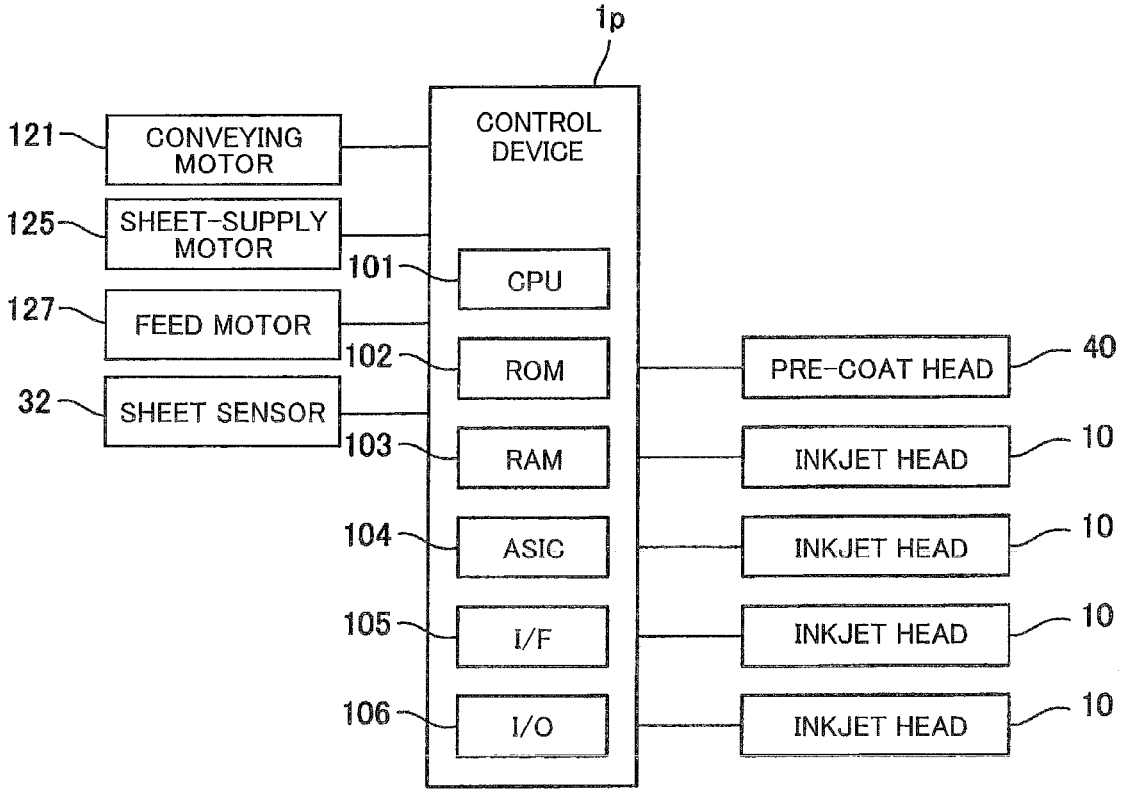
FIG. 5 is a block-diagram showing electrical configuration of the inkjet printer of FIG. 1.

As shown in FIG. 5, the control device 1*p* includes a CPU 101, a ROM 102, a RAM 103 (including non-volatile RAM), an ASIC 104, an interface (I/F) 105, and an input/output port (I/O) 106. The ROM 102 stores programs to be executed by the CPU 101, various fixed data (such as data relating to four types of driving signals for tone control, a table, predetermined amounts of the treating agent, and a specific ejection pattern, all of which will be described later), and the like. The RAM 103 temporarily stores data (such as image data corresponding to an image to be formed on a paper sheet P) required for executing programs. The ASIC 104 rewrites and sorts image data (performs signal processing and image processing). The I/F 105 exchanges data between an external device. The I/O 106 inputs and outputs detection signals of various sensors.

The control device 1*p* is electrically connected to the conveying motor 121, the sheet-supply motor 125, the feed motor 127, the sheet sensor 32, the control boards of the heads 10 and 40.

Next, driving signals used for tone control will be described with reference to FIG. 6. Note that the tone control executed in each inkjet head 10 will be described next, but the same tone control is also executed in the pre-coat head 40.

In this embodiment, there are four tone levels, and the ROM 102 stores four driving signals that respectively correspond to zero, small, medium, and large amounts of ink for forming a single pixel. Each driving signal is for changing the voltage applied to the individual electrode of the actuator unit 17 in a manner indicated by a heavy line in FIG. 6. The common electrode of the actuator unit 17 is constantly maintained at a low level (ground level: 0V).

In this embodiment, a "draw-and-eject" method is used as a driving method of the actuator. That is, ink is supplied into the pressure chamber 16 prior to ink ejection. More specifically, before the control device 1*p* receives a recording signal, all of the individual electrodes of the actuator unit 17 are maintained at a high level (15 V, for example), and the common electrode is maintained at the low level (0V). In this condition, all of the actuators of the actuator unit 17 are maintained deformed to protrude toward the pressure chambers 16. Upon receiving a recording signal, the control device 1*p* selects one of the driving signals and starts applying voltage based on the selected driving signal.

For example, if the ink amount is zero, then the voltage of the individual electrode is maintained at the high level, causing no change in the voltage. Thus, the actuator is maintained deformed toward the pressure chamber 16, and no ink is ejected from the nozzle 14*a*. When the ink amount is small, then the voltage of the individual electrode is changed from the high level to the same low level as the common electrode. As a result, the actuator changes its form to become parallel with the ejection surface 10*a* as shown in FIG. 4. This increases the volume of the pressure chamber 16, and stars drawing ink from the sub-manifold channel 13*a* into the pressure chamber 16. When ink from the sub-manifold channel 13*a* reaches the pressure chamber 16, the voltage of the individual electrode is returned from the low level to the high level. This deforms the actuator to protrude toward the pressure chamber 16 to reduce the volume of the pressure chamber 16. As a result, pressure is applied to the ink in the pressure chamber 16, and a single small ink droplet S (see FIG. 8(*a*)) is ejected from the nozzle 14*a*.

A series of operations including the ink supply to the pressure chamber 16 and the ink ejection from the nozzle 14*a* described above (i.e., drawing and ejection) is repeated as many time as the number of the voltage pulses. Note that the "voltage pulse" means a rectangular pulse shaped part of a voltage waveform having a falling edge and a rising edge with a time duration therebetween. The recording signal includes one, two, or three voltage pulses when the ink amount is small, medium, or large, and the series of operations is performed once, twice, or three times to eject a single, two, or three small ink droplets S. The two or three small ink droplets S ejected in this manner from the same nozzle 14*a* merge with each other to form a single medium or large droplet M or L (see FIG. 8(*b*)) in the air before impinging the paper sheet P, thereby forming a single pixel on the paper sheet P.

Figure 6:
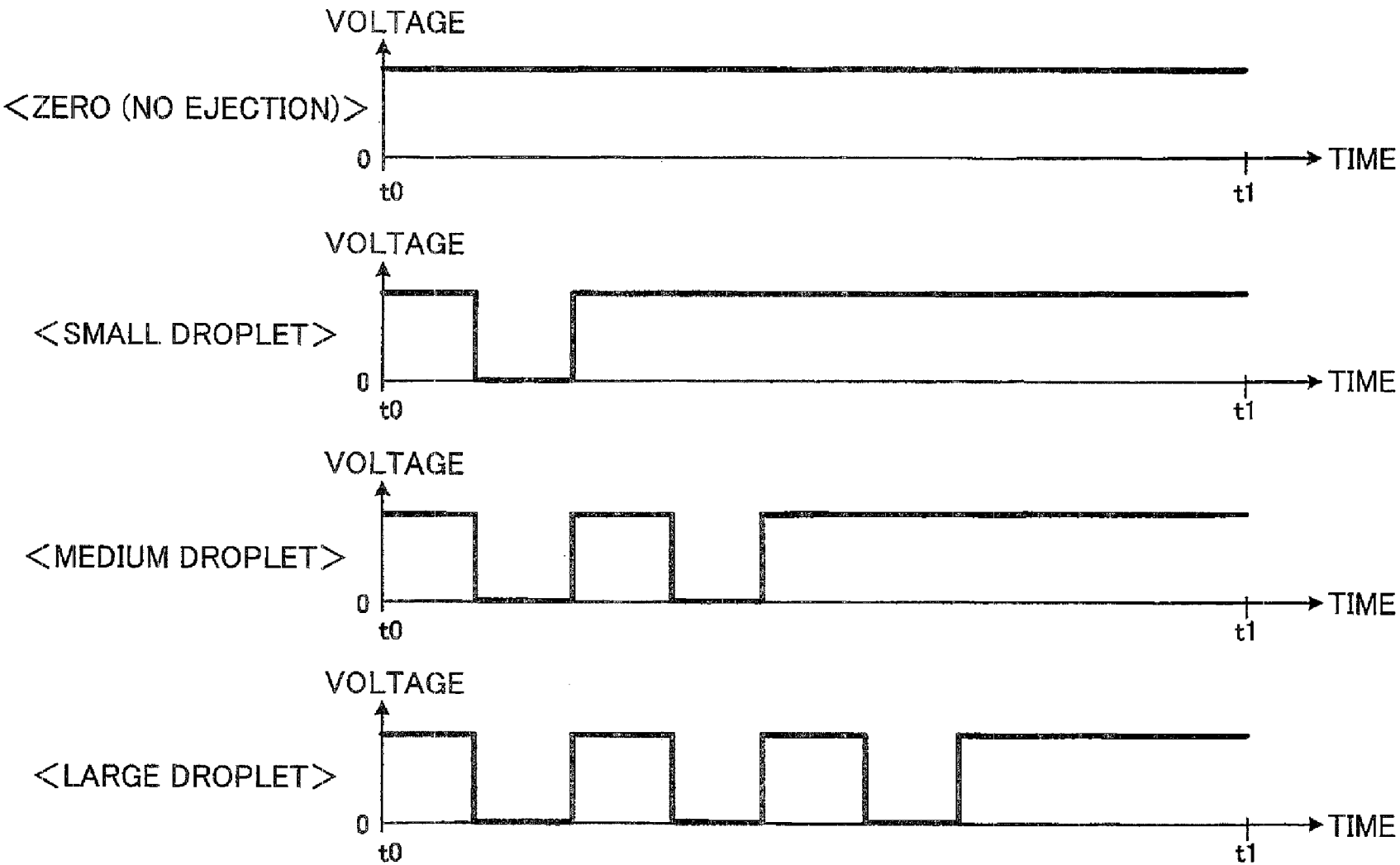
FIG. 6 is a view showing a voltage waveform specified by each of four different driving signals.

Note that FIG. 6 shows only voltage change in a single recording cycle (i.e., a time period required for the paper sheet P to move relative to the inkjet head 10 a unit of distance corresponding to a resolution of an image to be formed on the paper sheet P). In FIG. 6, "t0" indicates a start of a recording cycle, and "t1" indicates an end of the recording cycle. The time duration of the voltage pulse is equivalent to an acoustic length (AL), which is a one-way propagation time of pressure wave in the individual channel 14.

Figure 7:
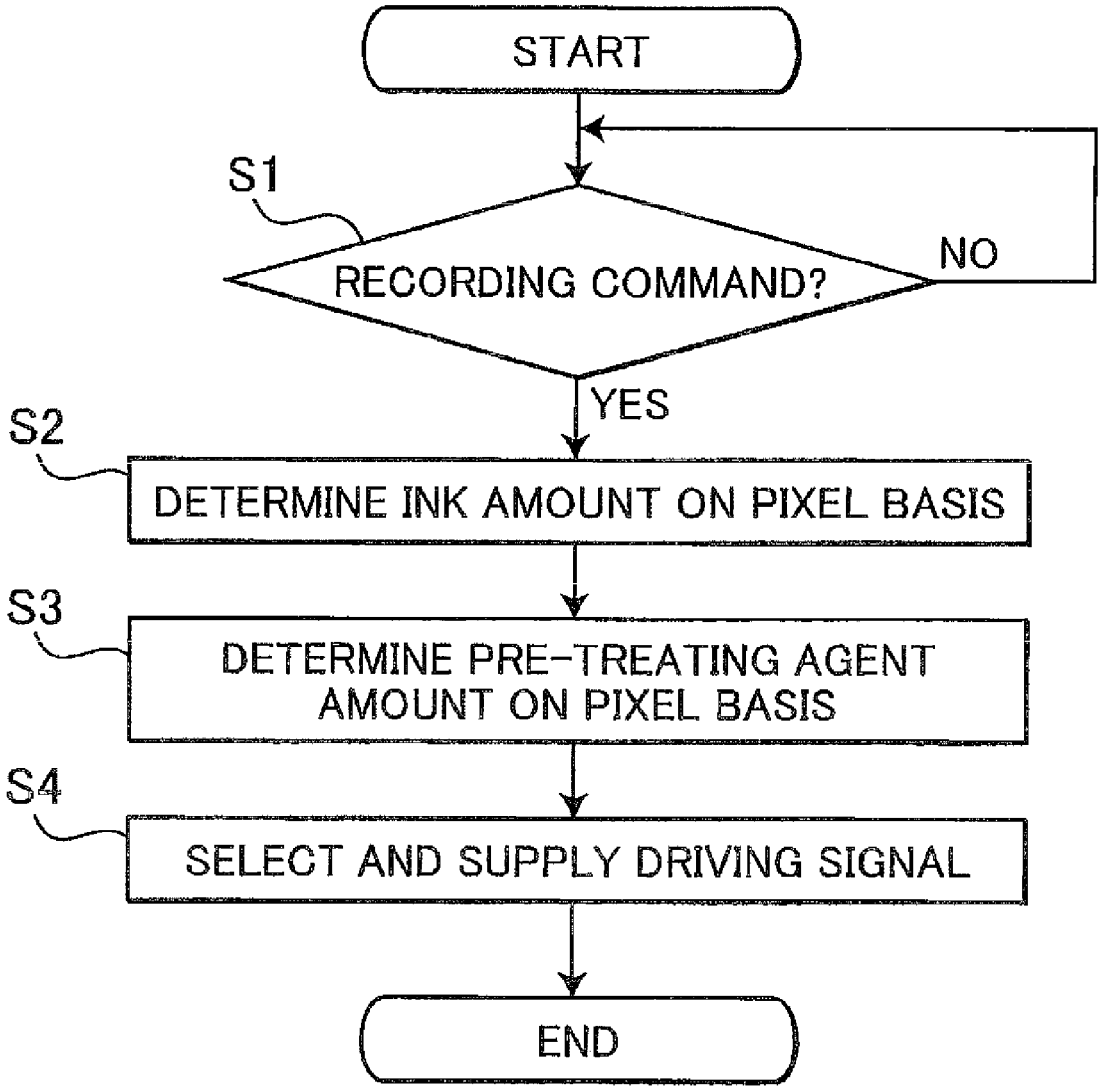
FIG. 7 is a flowchart representing a recording process executed according to the first embodiment of the invention.

Next, a recording process executed in the inkjet printer 1 will be described with reference to the flowchart of FIG. 7. The recording process is executed by the CPU 101 based on a program stored in the ROM 102 when the power to the inkjet printer 1 is ON.

First in S1, the CPU 101 determines whether or not a recoding command is received from an external device. If not (S1: No), then the CPU 101 repeats the determination in S1. On the other hand, if so (S1: Yes), then in S2 the CPU 101 stores image data and the like included in the recording command into the RAM 103, and determines on an image pixel basis an ink amount to be ejected from each nozzle 14*a* of the inkjet heads 10.

A method for determining the ink amount on the image pixel basis in S2 will be described with reference to FIGS. 8(*a*) to 10(*d*). In this embodiment, the CPU 101 determines the ink amount based on both an ink amount and an ejection pattern both obtained from the image data.

Figure 8A:
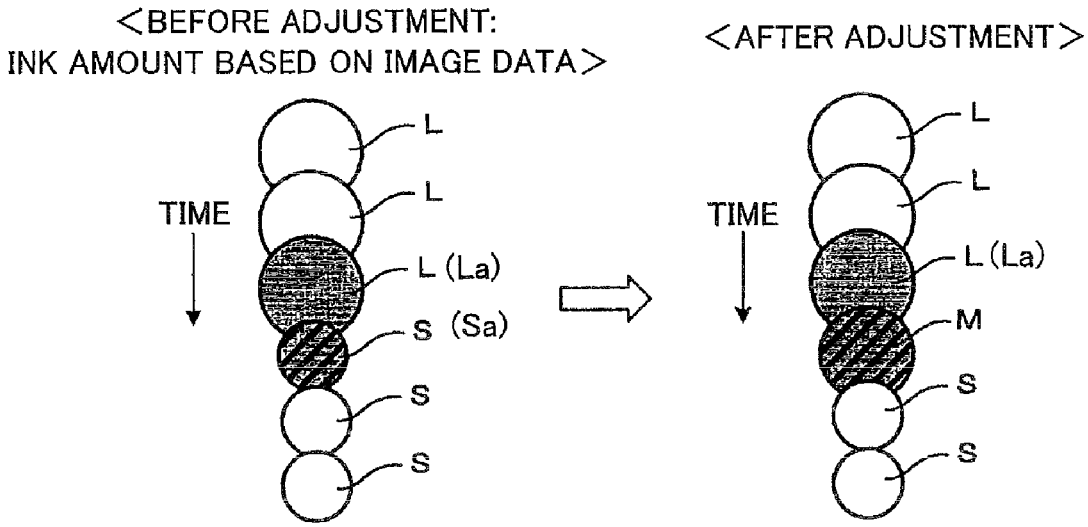
FIG. 8(*a*) is an explanatory diagram showing a first adjusting pattern according to the first embodiment of the invention.
Figure 8B:
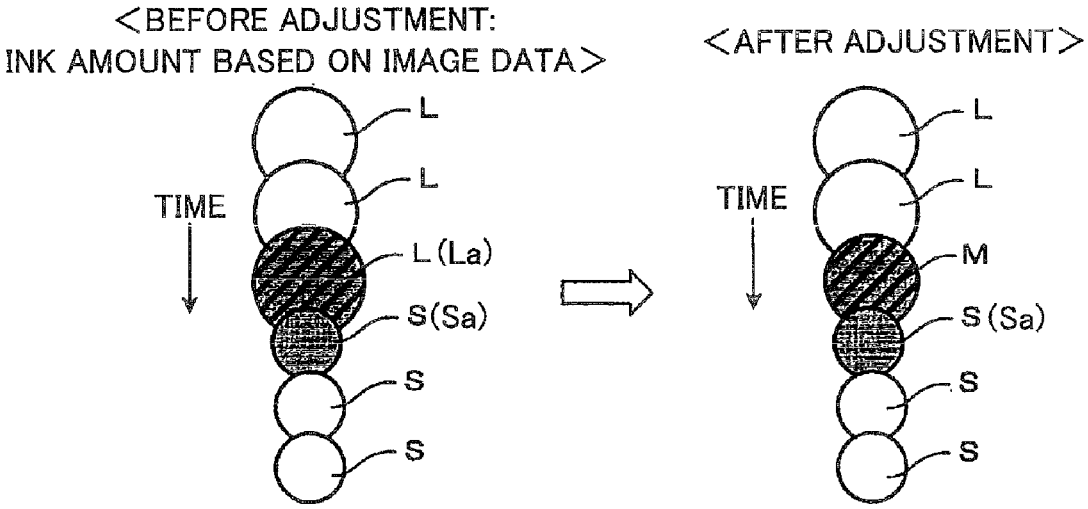

Each of FIGS. 8(*a*) and 8(*b*) shows ink amounts (ink droplets) to be ejected from a single nozzle 14*a* in sequence, and each of these ink droplets is for forming a single pixel on the paper sheet P. When ejecting a small ink droplet S immediately after three or more large ink droplets L have been ejected in succession, ejection of the small ink droplet S tends to be unstable. It is believed that one of the causes of this ejection instability is residue of meniscus oscillation and pressure wave in an ink channel generated in the preceding recording cycle.

Thus, in this embodiment, an ink amount is adjusted based on either one of two adjusting patterns shown in FIGS. 8(*a*) and 8(*b*). That is, an ink amount is changed from a corresponding ink amount obtained based on the image data to a different ink amount. Note that an ink amount obtained based on the image data will be hereinafter referred to as "original ink amount."

In this description, a small ink droplet S that is to be ejected immediately after three or more large ink droplets L have been ejected in succession will be hereinafter referred to as a "small ink droplet Sa," and an ink droplet L to be ejected immediately before the small ink droplet Sa will be hereinafter referred to as a "large ink droplet La," and these droplets Sa and La are indicated in gray color in FIGS. 8(*a*), 8(*b*), and the like.

In this embodiment, one of the large ink droplet La and the small ink droplet Sa is changed (replaced by) to a medium droplet M. According to a first adjusting pattern shown in FIG. 8(*a*), the small ink droplet (small ink amount) Sa indicated with hatched line is changed to a medium ink droplet M as shown on the right side. On the other hand, according to a second adjusting pattern shown in FIG. 8(*b*), the large ink droplet (large ink amount) La indicated with hatched line is changed to a medium ink droplet M as shown on the right side.

This ink amount adjustment can be performed by, for example, identifying a specific ejection pattern in the image data indicating successive ejection of three large droplets L (including La) and a small droplet Sa, selecting one of the large and small droplets La and Sa, and replacing the selected one of the droplet La and Sa with a medium droplet M. Note that the specific ejection pattern is stored as fixed data in the ROM 102 as mentioned above.

As will be described next in detail, one of the first and second adjusting patterns is selected based on whether or not pixel to be formed by the ink droplet La, Sa is at an edge of an image, or based on whether or not the pixel is at a boundary between a character region and a background region, and then either the ink droplet La or Sa is changed according to the selected on of the first and second adjusting patterns, from the point of view of ejection instability prevention. Also, when a single pixel to be formed by a plurality of ink droplets in different colors, then an ink amount for one color may be changed based on an adjusted ink amount of different color. Note that an "edge of an image" means an edge of a line image, a boundary between colors of the image, or the like. Also, characters include letters and symbols, and a character region means a region including a character of the image. Further, in a case other than Cases 1 to 3 described next, arbitrary one of the first and second adjusting pattern may be selected.

(Case 1)

When ink droplets to be ejected in succession from one nozzle 14*a* include the small and large ink droplets Sa and La, and if pixels to be formed by the ink droplets Sa and La form an edge of an image with pixels to be formed by another nozzle 14*a*, then either the first or second adjusting pattern is selected such that adjacent ones of the pixels formed by the different nozzles 14*a* have the same ink amount.

Figure 9A:
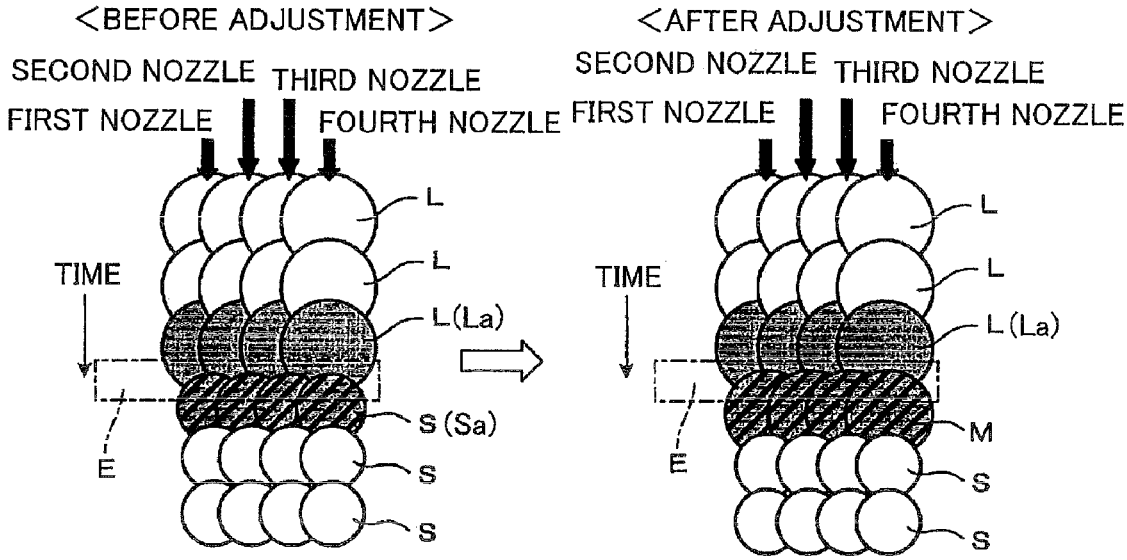
FIG. 9(*a*) is an explanatory diagram showing a first example of ink amount determining method.
Figure 9B:
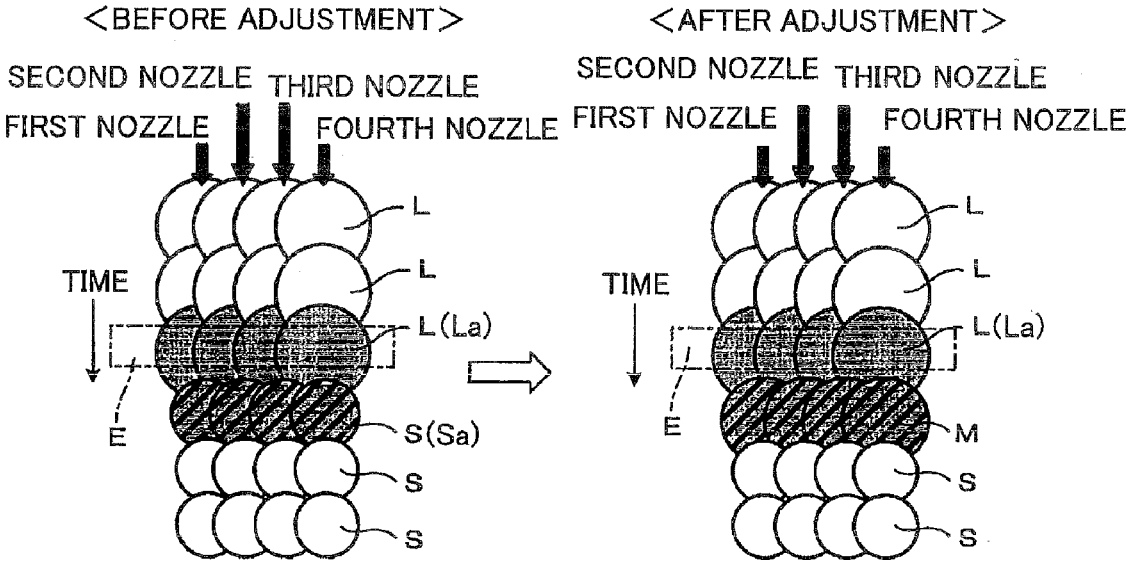

A specific example will be described with reference to FIG. 9(*a*). FIG. 9(*a*) shows, on its left side, four groups of ink droplets to be ejected in succession from each of four different nozzles 14*a* (first to fourth nozzles). Each of the ink droplets forms a single pixel on the paper sheet P. In this case, either one of the large ink droplet La and the small ink droplet Sa indicated in gray color of each group is changed to the medium ink droplet M, according to the first or second adjusting pattern. In this example, pixels to be formed by the large ink droplets La and the small ink droplets Sa are continuous and form the edge E of the image. Thus, the CPU 101 selects one of the first and second adjusting patterns such that ink droplets to be ejected from different nozzles 14*a* for forming adjacent pixels have the same ink amount. That is, the CPU 101 selects the first or the second adjusting pattern to change all of the four large ink droplets La or all of the four small ink droplets Sa.

In the example shown in FIG. 9(*a*), the first adjusting pattern shown in FIG. 8(*a*) is selected for each group, so the four small ink droplets Sa are all changed to medium ink droplets M as shown on the right side. However, the four large ink droplets La may be all changed to medium ink droplets M according to the second adjusting pattern instead.

That is, according to this embodiment, when a plurality of pixels to be formed in succession by one nozzle 14*a* includes two pixels that form the edge E of the image together with adjacent pixels to be formed by a different nozzle 14*a*, and when the CPU 101 determines an ink amount that is different from the original ink amount for one of the two pixels based on the first or second adjusting pattern, the CPU 101 determines such that the ink amount for the one of the two pixels is the same as an ink amount for one of the adjacent pixels to be formed adjacent to the one of the two pixels.

If the ink amount differs among pixels that together form the edge E of the image, then the edge becomes jagged or uneven to degrade image quality. However, the present embodiment can avoid such problem because the adjacent pixels forming the edge E have the same ink amount as described above.

(Case 2)

When a plurality of ink droplets to be ejected in succession by a single nozzle 14*a* includes the large and small ink droplets La and Sa, and if only one of the large and small ink droplets La and Sa forms a pixel for forming an edge E of an image, then the CPU 101 determines one of the first and second adjusting patterns such that the pixel for forming the edge E has the original ink amount, and the other pixel has an ink amount differing from the original ink amount.

A specific example will be described with reference to FIG. 9(*b*). FIG. 9(*b*) shows, on its left side, ink droplets in the same arrangement as those shown on the left side in FIG. 9(*a*). Although pixels corresponding to the large ink droplets La and the small ink droplets Sa are all for forming the edge E in FIG. 9(*a*), only pixels corresponding to the large ink droplets La are for forming the edge E in FIG. 9(*b*). In this case, the CPU 101 selects the second adjusting pattern to maintain the large ink droplets L and to change the small ink droplets Sa to the medium ink droplets M. As a result, the pixels corresponding to the large ink droplets La for forming the edge E have the same ink amount as the original ink amount, and the other pixels originally corresponding to the small ink droplets Sa have an ink amount (medium amount) different from the original ink amount.

That is, according to this embodiment, when two pixels to be formed in succession by a single nozzle 14*a* only include a single pixel for forming an edge of the image, and when determining an ink amount differing from the original amount for one of the two pixels, then the CPU 101 determines such that the single pixel has the original ink amount and such that the other of the two pixels has an ink amount differing from the original amount. In other words, no ink amount adjustment is performed for a pixel for forming the edge of the image based on the original ink amount and the ejection pattern, but ink amount adjustment is performed for the other pixels based on the original ink amount and the ejection pattern. With this configuration, it is possible to suppress unevenness of edge line and degradation of image quality due to an uneven edge line.

(Case 3)

When pixels to be formed by the large ink droplet La and the small ink droplet Sa are at a boundary between a character region and a background region of the image, then the CPU 101 selects one of the first and second adjusting patterns such that a pixel belonging to the character region has the original ink amount and such that a pixel belonging to the background region has an ink amount different from the original ink amount, by changing either the large ink droplet La or the small ink droplet Sa to the medium ink droplet M.

That is, according to this embodiment, when a plurality of pixels to be formed by a single nozzle 14*a* includes pixels to be formed at the boundary between the character region and the background region, and when determining an ink amount differing from the original ink amount for one of the pixels at the boundary, then the CPU 101 makes determination such that one of the pixels belonging to the character region has the original ink amount and such that the other of the pixels belonging to the background region has an ink amount different from the original ink amount.

In other words, no ink amount adjustment is performed for a pixel for forming the character, but ink amount adjustment is performed for a pixel for forming the background. With this configuration, it is possible to suppress unevenness appearing in the character region and degradation of image quality due to the unevenness in the character region.

Here, when a single pixel is to be formed by a combination of ink droplets in different colors, and when determining a greater ink amount than the original ink amount for one of the colors according to the first or second adjusting pattern, then the CPU 101 automatically determines a greater ink amount than the original ink amount for the other color as well. Also, when a single pixel is to be formed by a combination of ink droplets in different colors, and when determining a smaller ink amount than the original ink amount for one of the colors according to the first or second adjusting pattern, then the CPU 101 automatically determines a smaller ink amount than the original ink amount for the other color as well.

With this configuration, it is possible to suppress change in hue due to ink amount adjustment.

Figures 10A, 10B, 10C, 10D:
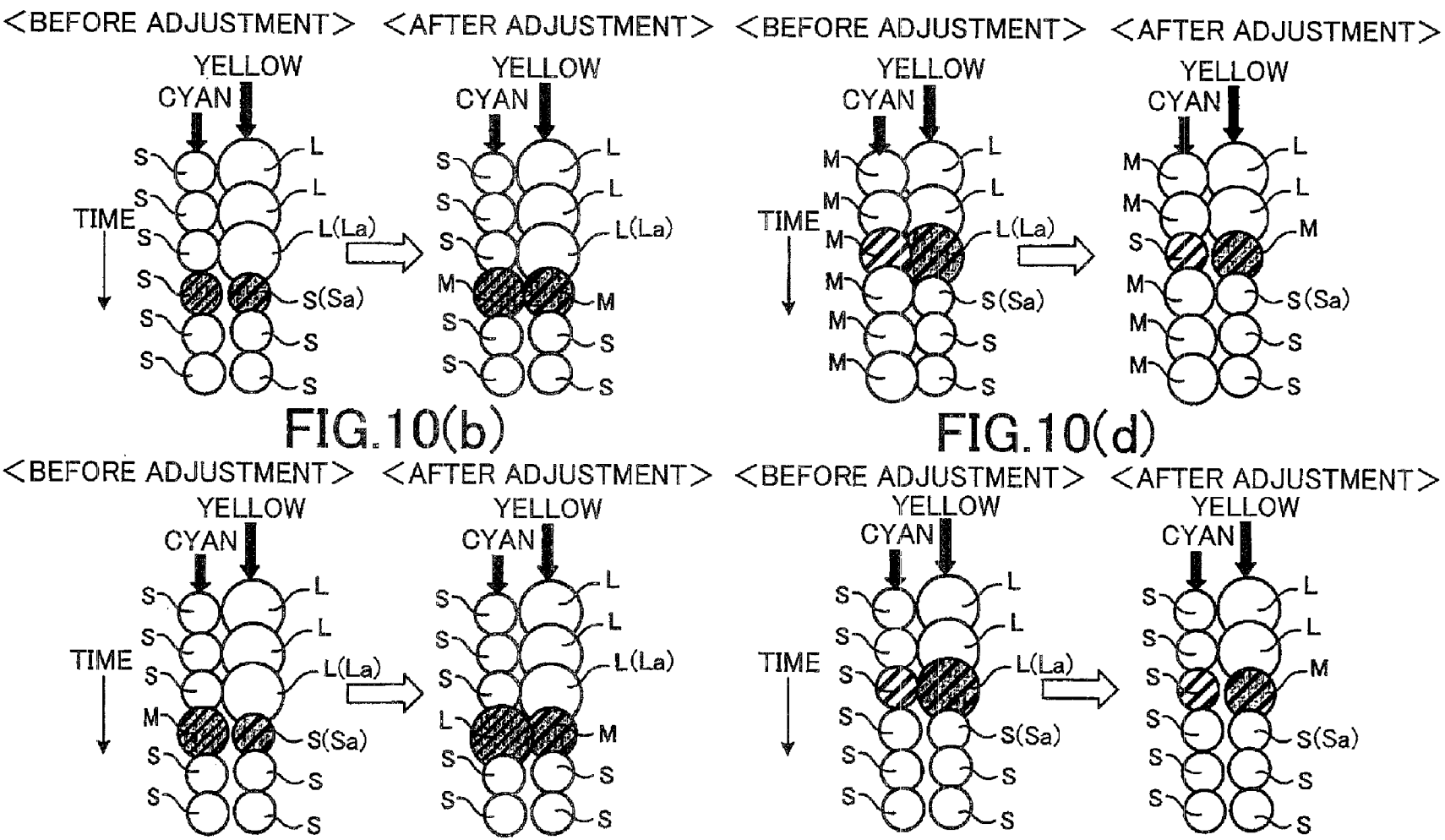
FIG. 10(*a*) is an explanatory diagram showing a third example of ink amount determining method.

For example, each of FIGS. 10(*a*) to 10(*d*) shows ink droplets to be ejected in succession from each of two nozzles 14*a*, one for yellow ink and the other for cyan ink. In the drawings, the yellow ink droplets and the cyan ink droplets are depicted at different positions in the right-left direction. However, each pair of ink droplets depicted adjacent to each other in the right-left direction in the drawings form dots one on the other to together form a single pixel on the paper sheet P.

In an example shown in FIG. 10(*a*), the CPU 101 changes a small yellow ink droplet Sa indicated with hatched line to a medium yellow ink droplet M according to the first adjusting pattern shown in FIG. 8(*a*). In accordance with this change, the CPU 101 also changes a small cyan ink droplet S indicated with hatched line to a medium cyan ink droplet M.

In an example shown in FIG. 10(*b*), the CPU 101 changes a small yellow ink droplet Sa indicated with hatched line to a medium yellow ink droplet M according to the first adjusting pattern. In accordance with this change, the CPU 101 also changes a medium cyan ink droplet M indicated with hatched line to a large cyan ink droplet L.

In an example shown in FIG. 10(*c*), the CPU 101 changes a large yellow ink droplet La indicated with hatched line to a medium yellow ink droplet M according to the second adjusting pattern shown in FIG. 8(*b*). In accordance with this change, the CPU 101 also changes a medium cyan ink droplet M indicated with hatched line to a small cyan ink droplet S.

In an example shown in FIG. 10(*d*), the CPU 101 changes a large yellow ink droplet La indicated with hatched line to a medium yellow ink droplet M according to the second adjusting pattern. In this case, however, the CPU 101 does not change a small cyan ink droplet S indicated with hatched line.

That is, even if an ink amount of one color (yellow, for example) is changed from the original ink amount (large, for example) to a smaller ink amount (medium, for example), the original ink amount for the other color (cyan, for example) is maintained the same, if the original ink amount for the other color is the minimum amount (i.e., small amount). Similarly, even if an ink amount of one color is changed from the original ink amount to a larger ink amount, the original ink amount for the other color is maintained the same, if the original ink amount for the other color is the maximum amount (i.e., large amount).

Note that although FIGS. 10(*a*) to 10(*d*) show the specific examples of ink amount determining methods, this is not limitation of the invention, and ink amount may be determined in various other methods. Also, although colors of yellow and cyan are used in these examples, the same methods can be used with different colors.

After S2 of FIG. 7, the CPU 101 determines in S3 an amount of the pre-treating agent (hereinafter referred to as "pre-treating agent amount") to be ejected from each nozzle of the pre-coat head 40 on an image pixel basis, based on a difference between the original ink amount and the ink amount determined in S2.

Specifically, if there is no difference, that is, if the ink amount determined in S2 is the same as the original ink amount (if amount of ink for forming a pixel has not been adjusted (changed) in S2), then the CPU 101 sets the pre-treating agent amount to a predetermined agent amount (including zero amount) obtained based on the image data. Note that predetermined agent amounts respectively corresponding to the four ink amounts (zero, small, medium, and large) are prestored in the ROM 102, and the CPU 101 extracts one of the predetermined agent amounts corresponding to the ink amount determined in S2, and determines the extracted agent amount as the pre-treating agent amount.

However, if there is a difference, then the CPU 101 determines the pre-treating agent amount such that an ink density corresponding to a combination of the ink of the ink amount determined in S2 and the pre-treating agent of the pre-treating agent amount comes closer to an ink density corresponding to the original ink amount. That is, the CPU 101 determines a pre-treating agent amount differing from the predetermined agent amount mentioned above. By doing so, it is possible to make the density of the recorded image closer to the density specified by the image data, effectively suppressing degradation of image quality due to density difference.

More specifically, if the ink amount determined in 82 is larger than the original ink amount, then the CPU 101 determines a smaller pre-treating agent amount than the predetermined agent amount. On the other hand, if the ink amount determined in S2 is smaller than the original ink amount, then the CPU 101 determines a larger pre-treating agent amount than the predetermined agent amount.

For example, when an original small ink amount Sa is changed to a medium ink amount M for a pixel according to the first adjusting pattern shown in FIG. 8(*a*), the CPU 101 determines, for the pixel, a smaller pre-treating agent amount than the predetermined agent amount (zero amount, for example) corresponding to the small ink amount S. This makes it possible to suppress density increase due to larger ink ejection amount than the original ink amount by ejecting the smaller amount of pre-treating agent than the predetermined agent amount.

On the other hand, when an original large ink amount La is changed to a medium ink amount M for a pixel according to the second adjusting pattern shown in FIG. 8(*b*), then the CPU 101 determines, for the pixel, a larger pre-treating agent amount than the predetermined agent amount corresponding to the large ink amount L. This makes it possible to suppress density decrease due to smaller ink ejection amount than the original ink amount by ejecting the larger amount of pre-treating agent than the predetermined agent amount.

Thus, it is possible to farther reliably suppress degradation of image quality caused by density difference.

Next in S4, the CPU 101 selects on an image pixel basis one of the four driving signals (FIG. 6) corresponding to the ink amount determined in S2 and one of the four driving signals corresponding to the pre-treating agent amount determined in S3, and supplies the selected driving signals to the control boards of the respective heads 10 and 40. Upon supplied with the driving signal, the actuator unit 17 of the head 10, 40 is driven to eject ink or pre-treating agent by the amount determined in S2, S3. At this time, the CPU 101 controls such that ink and pre-treating agent are ejected in synchronization with the conveyance of the paper sheet P by driving of each motor 121, 125, 127 (FIG. 5). After completing printing based on the recording command received in S1, the CPU 101 ends the recording process.

As described above, according to the present embodiment, an amount of ink to be ejected from each nozzle 14*a* is determined based on the original ink amount and the ejection pattern (S2). Thus, it is possible to suppress ejection instability due to ejection history. Also, if there is a difference between the ink amount determined in S2 and the original ink amount that is obtained based on the image data, then the amount of pre-treating agent is determined such that the ink density corresponding to the combination of the ink of the ink amount determined in S2 and the pre-treating agent of the pre-treating agent amount comes closer to the ink density corresponding to the original ink amount (S3). Thus, it is possible to suppress degradation of image quality due to density difference.

The pre-treating agent may not sufficiently enhance the density when a pixel has a high lightness value. Thus, when there is the above-mentioned difference between the ink amounts, the CPU 101 preferably determines a pre-treating agent amount for a pixel with a high lightness value in S3 that is smaller than a pre-treating agent amount for a pixel with a lower lightness value that is determined when there is the difference between the ink amounts. By reducing the usage amount of the pre-treating agent for the pixel with a high lightness value in this manner, consumption of the pre-treating agent can be saved. This also shortens the dry time, if application of the pre-treating agent elongates the dry time.

Likelihood of occurrence of ink blur or ink seep through differs depending on the type of the paper sheet P. Thus, it is preferable that the CPU 101 determine an ink amount in accordance with the type of the paper sheet P in S2. Specifically, if ink blur or ink seep through easily occurs with the paper sheet P, then a smaller ink amount and a larger pre-treating agent amount are determined. If ink seep through hardly occurs with the paper sheet P, then a larger ink amount and a smaller pre-treating agent amount are determined. With this configuration, it is possible to effectively prevent such problems as ink bur or ink seep through.

Next, a second embodiment of the invention will be described.

In the above-described first embodiment, an ink amount is determined for each image pixel in S2, and then a pre-treating agent amount is determined for each image pixel in S3. On the other hand, according to this embodiment, a tentative pre-treating agent application pattern (tentative pre-treating agent amount) is determined tentatively after S1 of FIG. 7, and an ink amount differing from the original ink amount is determined in S2 based further on the tentative pre-treating agent application pattern. Then, a pre-treating agent amount is determined on an image pixel basis in S3 based on the tentative pre-treating agent application pattern and a difference between the ink amount determined in S2 and the original ink amount.

For example, the CPU 101 may tentatively determine that a fixed amount (other than zero amount) of pre-treating agent is applied to all the pixels. In this case, applying additional amount of pre-treating agent to a pixel to which the fixed amount of pre-treating agent is tentatively determined to be applied (changing to a larger pre-treating agent amount) hardly enhance the density. In this case, the CPU 101 selects the first adjusting pattern shown in FIG. 8(*a*) to change a small ink amount Sa for a pixel to a medium ink amount M in S2, and determines a smaller pre-treating agent than the fixed amount for the pixel in S3. This saves the pre-treating agent, shortens the dry time, and also suppresses degradation of image quality due to density difference.

Alternatively, the CPU 101 may tentatively determine that no pre-treating agent is applied to any pixels (fixed amount=zero amount). In this case, a pre-treating agent amount smaller than the fixed amount cannot be determined, so the CPU 101 selects the second adjusting pattern shown in FIG. 8(*b*) to change a large ink amount La for a pixel to a medium ink amount M in S2, and determines a positive amount as a pre-treating agent amount for the pixel in S3.

As described above, according to this embodiment, an ink amount can be determined based on a tentative pre-treating agent amount that has been tentatively determined.

While the invention has been described in detail with reference to the embodiments thereof, it would be apparent to those skilled in the art that various changes and modifications may be made therein without departing from the spirit of the invention.

For example, the driving signals are not limited to those shown in FIG. 6, but may be modified in various manners. For example, the number of voltage pulses included in a voltage waveform indicated by each driving signal, a pulse width, a high-level voltage, and a low-level voltage may be changed arbitrarily. Also, the voltage specified by each driving signal may include a cancel pulse (a voltage pulse for reducing residual pressure wave generated in the ink channel by ink ejection in a current recording cycle). Further, the driving signals may not include the four types of driving signals (corresponding to zero, small, medium, and large amount), as long as the signals include at least two types of driving signals each corresponding to an amount other than zero amount. For example, three driving signals respectively corresponding to zero, small, and large amounts can be used. Moreover, an ink amount (of each gray level) specified by each of plural types of driving signals may be realized by a different volume of a single droplet, not only by a different number of ink droplets.

The ejection pattern indicates ink amounts to be ejected from the same and/or different nozzle 14*a* in a recording cycle prior to and/or following a current recording cycle.

A method for determining an ink amount on an image pixel basis is not limited to those described above, but may be different methods as long as ejection instability due to ejection history can be suppressed. For example, an ink amount to be ejected from a specific nozzle 14*a* may be determined based on ejection pattern of the specific nozzle 14*a* in both or either of recording cycles immediately prior to and immediately after a current recording cycle. Ejection pattern of one nozzle 14*a* may also be considered when determining an ink amount to be ejected from a different nozzle 14*a*. For example, from the point of view of suppression of crosstalk, ejection pattern of a group of nozzles 14*a* that corresponds to either a single actuator unit 17 or a single sub-manifold channel 13*a* may be considered when making determination.

The driving method of the actuator is not limited to the "draw-and-eject" method mentioned above, but may be a "project-and-eject" method, in which the actuator held in flat is deformed to protrude into the pressure chamber 16 upon driving voltage application, thereby eject ink from the nozzle 14*a*.

Although the above-described embodiments use the pre-treating agent, post-treating agent can be used instead of the pre-treating agent. Alternatively, both the pre-treating agent and the post-treating agent can be used. In this case, ejection amounts of the post-treating agent or of both the pre-treating agent and the post-treating agent are adjusted according to the adjusted ink amount. Also, the treating agent is not limited to liquid, but may be solid (including film-shaped).

An ejection energy generating unit of each of the inkjet heads 10 and the pre-coat head 40 is not limited to the piezoelectric or electrostatic actuator, but may be thermal heater element, for example.

In the above-described embodiments, the pre-coat head 40 having the same configuration as the inkjet head 10 is used for applying the pre-treating agent onto the paper sheet P. However, a treating-agent application member for applying the treating agent to the paper sheet P is not limited to the pre-coat head 40 described above. For example, the treating-agent application member may be a roller (pressure roller, thermal transfer roller, or the like) that has a surface holding treating agent and that applies the treating agent to the paper sheet P by contacting the surface with the paper sheet P.

The invention is applicable to either a line printer or a serial printer, and is also applicable to a facsimile device or a copier device. Droplets ejected from the nozzles 14*a* are not limited to ink droplets.

A various types of recording medium other than the paper sheet P mentioned above may be used.

What is claimed is:

1. A control device for controlling a droplet ejection device including: a channel unit formed with an ejection opening through which liquid is ejected to form a pixel on a recording medium and a pressure chamber fluidly connected to the ejection opening; an actuator that applies pressure to liquid in the pressure chamber to eject the liquid through the ejection opening; and a treating-agent application member that applies onto the recording medium a treating agent having a function to enhance density of the liquid ejected onto the recording medium, comprising:

a processor configured to execute instructions that cause the processor to provide functional units including:

a first determining unit that determines a first amount of the liquid to be ejected through the ejection opening on an image pixel basis based on both a corresponding second amount of the liquid specified by image data corresponding to an image to be formed on the recording medium and ejection pattern obtained from the image data;

an actuator control unit that controls the actuator to eject the first amount of the liquid through the ejection opening;

a second determining unit that determines a third amount of the treating agent to be applied by the treating-agent application member on an image pixel basis based on a difference between the first amount and the second amount, the second determining unit determining the third amount such that a first density of the liquid corresponding to a combination of the first amount of the liquid and the third amount of the treating agent comes closer to a second density of the liquid corresponding to the second amount of the liquid when there is a difference between the first amount and the second amount; and a control unit that controls the treating-agent application member to apply the third amount of the treating agent to the recording medium.

2. The control device according to claim 1, wherein the second determining unit determines the third amount differing from a predetermined amount obtained based on the image data when there is a difference between the first amount and the second amount.

3. The control device according to claim 2, wherein:

the second determining unit determines the third amount that is smaller than the predetermined amount when the first amount is greater than the second amount; and the second determining unit determines the third amount that is larger than the predetermined amount when the first amount is smaller than the second amount.

4. The control device according to claim 1, wherein when a plurality of pixels to be formed in succession by a first ejection opening includes two pixels that form an edge of the image together with adjacent pixels to be formed by a second ejection opening differing from the first ejection opening, and when the first determining unit determines the first amount that is different from the second amount for one of the two pixels based on the second amount and the ejection pattern, the first determining unit determines such that the first amount for the one of the two pixels is the same as the first amount for one of the adjacent pixels to be formed adjacent to the one of the two pixels.

5. The control device according to claim 1, wherein when two pixels to be formed in succession by a first ejection opening only include a single pixel for forming an edge of the image, and when the first determining unit determines the first amount that is different from the second amount for one of the two pixels based on the second amount and the ejection pattern, the first determining unit determines such that the first amount for the single pixel for forming the edge of the image is the same as the second amount and such that the first amount for the other of the two pixels is different from the second amount.

6. The control device according to claim 1, wherein:

when a single pixel is to be formed by a combination of liquid in different colors, and when the first determining unit determines the first amount that is larger than the second amount for the liquid in one color based on the second amount and the ejection pattern, the first determining unit automatically determines the first amount that is larger than the second amount for the liquid in the other color; and when a single pixel is to be formed by a combination of liquid in different colors, and when the first determining unit determines the first amount that is smaller than the second amount for the liquid in one color based on the second amount and the ejection pattern, the first determining unit automatically determines the first amount that is smaller than the second amount for the liquid in the other color.

7. The control device according to claim 1, wherein the second determining unit determines the third amount such that an amount of the treating agent for a pixel with a higher lightness value is smaller than an amount of the treating agent for a pixel with a lower lightness value when there is a difference between the first amount and the second amount.

8. The control device according to claim 1, wherein when the image includes a character region and a background region which is a background of the character region, and when the first determining unit determines the first amount that is different from the second amount for one of two pixels to be formed at a boundary between the character region and the background region based on the second amount and the ejection pattern, the first determining unit determines such that a first one of the two pixels belonging to the character region has the first amount that is the same as the second amount and such that a second one of the two pixels belonging to the background region has the first amount that is different from the second amount.

9. The control device according to claim 1, wherein:

the functional units further includes a tentative determining unit that tentatively determines a tentative application pattern of the treating agent before the first determining unit makes determination;

the first determining unit determines the first amount based further on the tentative application pattern when determining the first amount differing from the second amount; and the second determining unit determines the third amount based further on the tentative application pattern.

10. The control device according to claim 1, wherein the first determining unit determines the first amount based further on a type of the recording medium.

11. The control device according to claim 1, wherein the first determining unit includes a first unit that identifies a specific ejection pattern in the image data, the specific ejection pattern indicating successive ejection of first, second, and third large droplets and a small droplet, a second unit that selects one of the third large droplet and the small droplet, and a third unit that determines the first amount differing from the original amount by replacing the selected one of the third large droplet and the small droplet with a medium droplet.

12. A non-transitory computer readable storage medium storing a set of program instructions installed on and executed by a computer for controlling a droplet ejection device including: a channel unit formed with an ejection opening through which liquid is ejected to form a pixel on a recording medium and a pressure chamber fluidly connected to the ejection opening; an actuator that applies pressure to liquid in the pressure chamber to eject the liquid through the ejection opening; and a treating-agent application member that applies onto the recording medium a treating agent having a function to enhance density of the liquid ejected onto the recording medium, the program instructions comprising:

determining a first amount of the liquid to be ejected through the ejection opening on an image pixel basis based on both a corresponding second amount of the liquid specified by image data corresponding to an image to be formed on the recording medium and ejection pattern obtained from the image data;

controlling the actuator to eject the first amount of the liquid through the ejection opening;

determining a third amount of the treating agent to be applied by the treating-agent application member on an image pixel basis based on a difference between the first amount and the second amount, such that a first density of the liquid corresponding to a combination of the first amount of the liquid and the third amount of the treating agent comes closer to a second density of the liquid corresponding to the second amount of the liquid when there is a difference between the first amount and the second amount; and controlling the treating-agent application member to apply the third amount of the treating agent to the recording medium.

13. A droplet ejection device comprising:

a channel unit formed with an ejection opening through which liquid is ejected to form a pixel on a recording medium and a pressure chamber fluidly connected to the ejection opening;

an actuator that applies pressure to liquid in the pressure chamber to eject the liquid through the ejection opening;

a treating-agent application member that applies onto the recording medium a treating agent having a function to enhance density of the liquid ejected onto the recording medium;

a first determining unit that determines a first amount of the liquid to be ejected through the ejection opening on an image pixel basis based on both a corresponding second amount of the liquid specified by image data corresponding to an image to be formed on the recording medium and ejection pattern obtained from the image data;

an actuator control unit that controls the actuator to eject the first amount of the liquid through the ejection opening;

a second determining unit that determines a third amount of the treating agent to be applied by the treating-agent application member on an image pixel basis based on a difference between the first amount and the second amount, the second determining unit determining the third amount such that a first density of the liquid corresponding to a combination of the first amount of the liquid and the third amount of the treating agent comes closer to a second density of the liquid corresponding to the second amount of the liquid when there is a difference between the first amount and the second amount; and a control unit that controls the treating-agent application member to apply the third amount of the treating agent to the recording medium.

* * * * *